US005834901A

United States Patent [19]

Shen

[11] Patent Number: 5,834,901

[45] Date of Patent: Nov. 10, 1998

[54] FLASHING LIGHT STRING ASSEMBLY WITH A PAIR OF SUB-LIGHT STRINGS PER PLUG

[76] Inventor: Ya-Kuang Shen, 10/F-7, No. 32, Yung-Chi Rd., Taipei City, Taiwan

[21] Appl. No.: 852,128

[22] Filed: May 6, 1997

[51] Int. Cl.[6] ..... H05B 37/02

[52] U.S. Cl. ..... 315/185 S; 362/806

[58] Field of Search ..... 315/185 S; 362/249, 362/806

[56] References Cited

U.S. PATENT DOCUMENTS 5,150,964 9/1992 Tsui ..... 362/806 X 5,245,519 9/1993 Openiano ..... 362/806 X 5,345,147 9/1994 Wu ..... 315/185 S

*Primary Examiner*—Robert J. Pascal

*Assistant Examiner*—Justin P. Bettendorf

*Attorney, Agent, or Firm*—Rosenberg, Klein & Bilker

[57] ABSTRACT

A flashing light string assembly including a bus line connected to a power circuit through a flash controller and having one grounding wire and a plurality of hot wires and a plurality of sockets connected to its grounding and hot wires, and a plurality of light strings having each a plurality of sub-light strings connected in parallel to a respective plug adapted for connecting to one socket of the bus line.

1 Claim, 3 Drawing Sheets

FLASHING LIGHT STRING ASSEMBLY WITH A PAIR OF SUB-LIGHT STRINGS PER PLUG

BACKGROUND OF THE INVENTION

The present invention relates to a flashing light string assembly which is comprised of a plurality of light strings connected in parallel to a bus line and controlled to flash at different frequencies by a flash controller.

A regular flashing light string assembly is generally comprised of a bus line connected to power supply, a flash controller, and a plurality of light strings connected to the bus line through the flash controller. The bus line comprises one grounding wire (or hot wire) and a plurality of hot wires (or grounding wires). The light strings have each one end connected to the grounding wire, and the other end connected to one hot wire. However, the light strings are not connected to one common hot wire, they can be driven to flash at different frequencies. The connections between the bus line and the light strings are made by sockets and plugs. The sockets are made at the bus line. The plugs are made at the light strings. Each socket has a plurality of electrically conductive plug holes respectively connected to the grounding and hot wires of the bus line. Each plug has two plug pins respectively connected to the grounding plug hole and one hot plug hole of one socket. During the installation of the light strings, the hot plug pins of the plugs must be connected to different hot wires of the bus line so that the light strings can be driven to flash at different frequencies. If the hot plug pins of the plugs are connected to the same hot wire, the light strings cannot be driven to flash at different frequencies.

SUMMARY OF THE INVENTION

It is one object of the present invention to provide a flashing light string assembly which enables same light strings to be controlled to flash at different frequencies. It is another object of the present invention to provide a flashing light string assembly which is easy to install and inexpensive to manufacture. According to the present invention, the flashing light string assembly comprises a power circuit, a flash controller connected to the power circuit to receive electricity from it, a bus line having a grounding wire and a plurality of hot wires respectively connected to respective contacts of the flash controller to receive electricity from it, and a plurality of light strings respectively connected to the bus line and controlled to flash by the flash controller. The bus line comprises a plurality of sockets, each socket comprising a grounding tubular terminal and a plurality of hot tubular terminals respectively connected to the grounding wire and hot wires of the bus line. Each light string is comprised of a plug adapted for connecting to one socket of the bus line, and a plurality of sub-light strings connected in parallel. The plug comprises a grounding rod terminal and a plurality of hot rod terminals respectively connected to the grounding tubular terminal and hot tubular terminals of one socket. Each light strings has a common grounding wire and a plurality of hot wires respectively connected to the grounding rod terminal and hot rod terminals of the respective plug.

DETAILED DESCRIPTION OF THE PREFERRED EMBODIMENT

Figure 1:
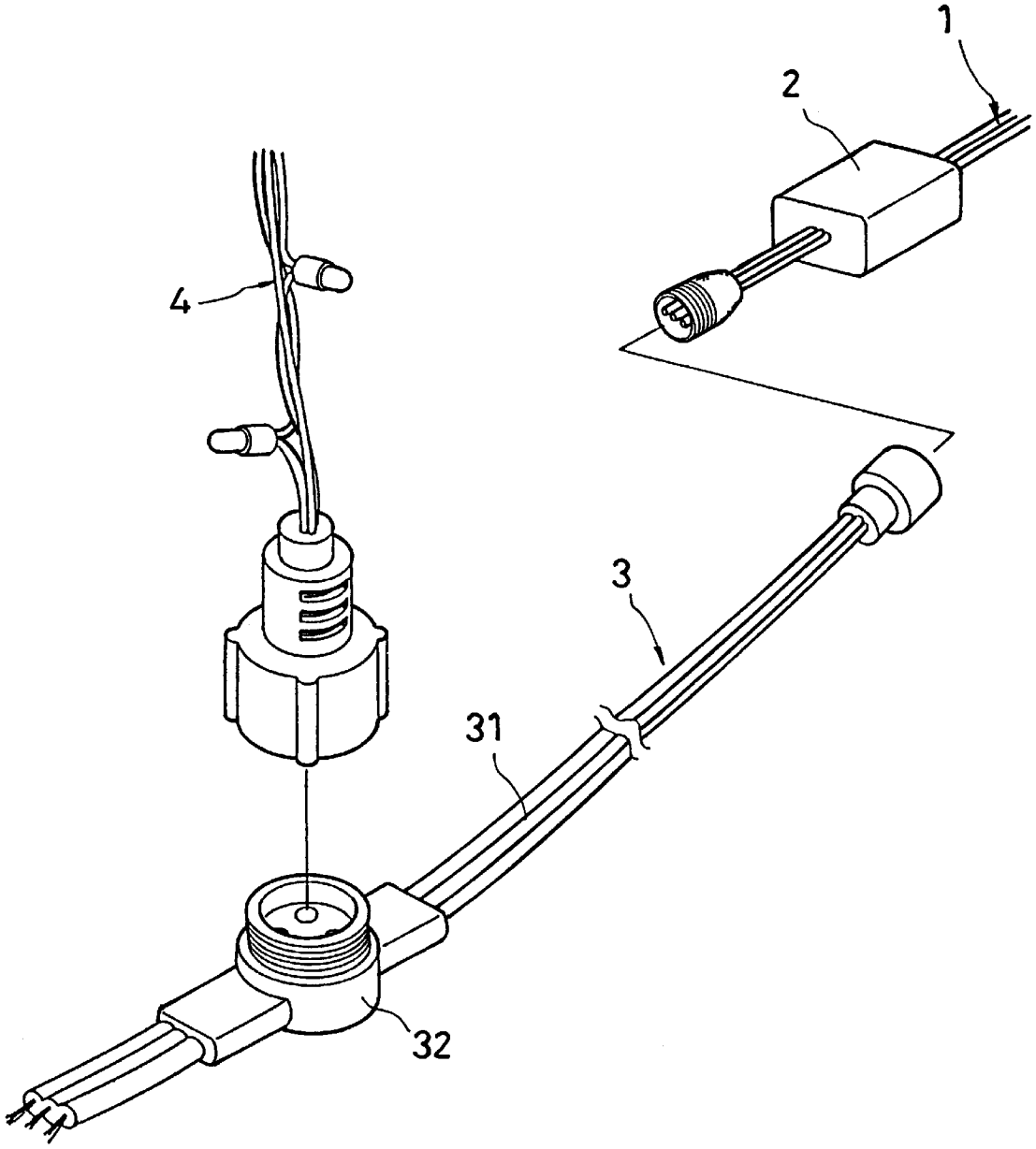
FIG. 1 is an exploded view of a flashing light string assembly according to the present invention.
Figure 2:
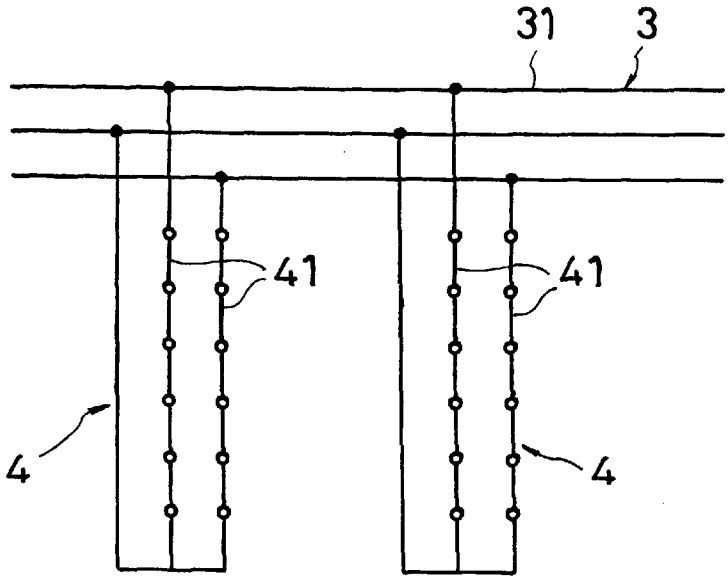
FIG. 2 is a schematic drawing showing the sub-light strings of the light strings connected in parallel to the conductors of the bus line according to the present invention.

Referring to FIG. 1, a flashing light string assembly in accordance with the present invention is generally comprised of a power circuit 1, a flash controller 2, a bus line 3, and a plurality of light strings 4. Electricity is inputted from the power circuit 1 into the flash controller 2, and then outputted through the bus line 3 to the light strings 4. The bus line 3, as shown in FIG. 2 comprises a plurality of conductors 31 including one grounding wire and several hot wires.

Figure 4:
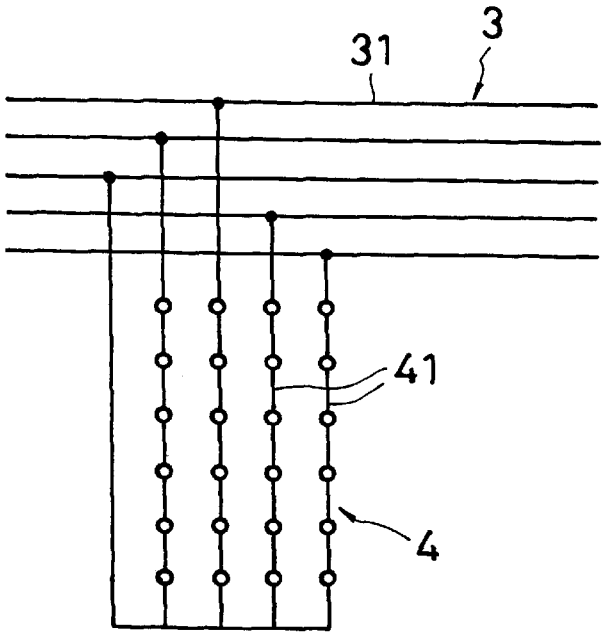
FIG. 4 shows an alternate arrangement of the light strings and the bus line according to the present invention.
Figure 3:
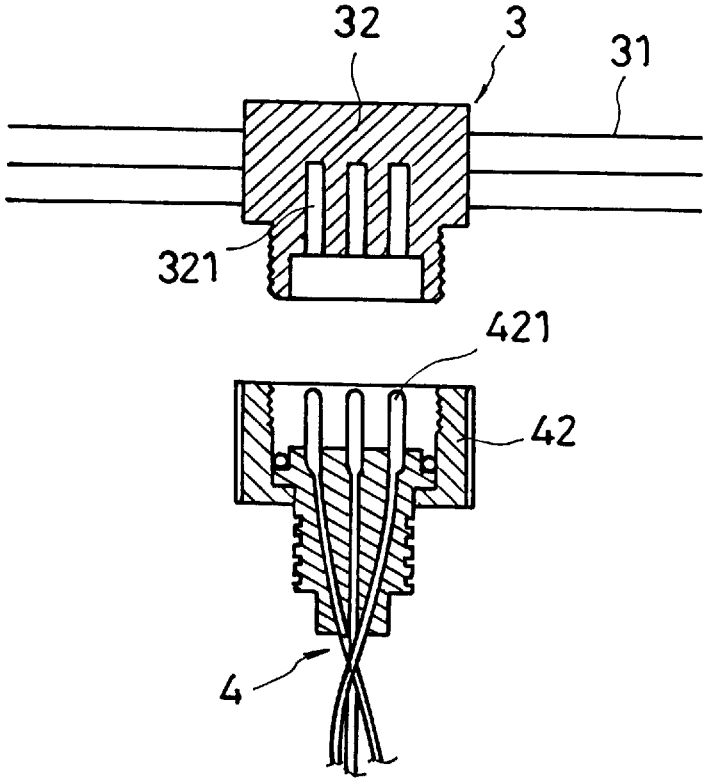
FIG. 3 is a sectional view showing the relationship between one socket of the bus line and the plug of one light string according to the present invention.

Referring to FIG. 3, the bus line 3 comprises a plurality of sockets 32 adapted for receiving the light strings 4. Each socket 32 comprises a plurality of tubular terminals 321 respectively connected to the conductors 31 of the bus line 3. Each light string 4, as shown in FIG. 4 is comprised of a plurality of sub-light strings 41 connected in parallel, having a common grounding wire and a plurality of hot wires. The light strings 4 are respectively connected to the sockets 32 of the bus line 3 by a respective plug 42. The plug 42 comprises a plurality of rod terminals 421 corresponding to the tubular terminals 321 of the sockets 32. When the plugs 42 of the light strings 4 are respectively connected to the sockets 32 of the bus line 3, the grounding rod terminals 421 of the plugs 42 are respectively connected to the grounding tubular terminals 321 of the sockets 32, and the hot rod terminals 421 of the plugs 42 are respectively connected to the hot tubular terminals 321 of the sockets 32.

When the flash controller 2 is operated, the conductors 31 of the bus line 3 are electrically connected in a predetermined sequence, thereby causing the light strings 4 to be turned on or off. Because each light string 4 is comprised of a plurality of sub-light strings 41 respectively connected to the conductors 31 (sockets 32) of the bus line 3 through the rod terminals 421 of the plugs 42, the sub-light strings 41 are turned on and off at the predetermined sequence.

Further, the sub-light strings 41 of the light strings 4 are respectively connected in parallel to the plugs 42. Each sub-light string 41 has one end connected to the grounding rod terminal 421 of the respective plug 42, and an opposite end randomly connected to one hot rod terminal 421 thereof. Therefore, the light strings 4 can be controlled to flash at different frequencies. Because the light strings 4 are identical, they are easy to manufacture and to install.

Referring to FIG. 4, the number of the conductors 31 of the bus line 3 may be increased subject to the number of the sub-light strings 41 of each light string 4.

It is to be understood that the drawings are designed for purposes of illustration only, and are not intended as a definition of the limits and scope of the invention disclosed.

What is claimed is:

1. A flashing light string assembly, comprising:

a power circuit;

a flash controller connected to said power circuit for providing power therefrom to intermittently energize output lines thereof, said output lines being coupled to a first plug;

a bus line connected to said flash controller and having a first grounding wire and a plurality of wires intermittently energized by said flash controller in a predetermined sequence;

a plurality of electrical sockets coupled to said bus line, each of said plurality of sockets including a first tubular terminal connected to said grounding wire and a plurality of second tubular terminals respectively connected to said plurality of wires of said bus line, one of said plurality of electrical sockets being disposed at an end portion of said bus line for matingly and releasably coupling of said first plug thereto; and, a plurality of light strings coupled to said bus line, each of said plurality of light strings including (a) at least a pair of sub-light strings, each of said pair of sub-light strings having a plurality of serially coupled light bulbs and a pair of opposing leads, (b) a second grounding wire coupled to a first of said pair of leads of each of said pair of sub-light strings, (c) a plurality of conductors, each of said plurality of conductors being coupled to a second of said pair of leads of a respective one of said sub-light strings, and (d) a second plug matingly and releasably coupled to a respective one of said plurality of electrical sockets, said second plug including a first rod-shaped terminal connected to said second grounding wire for mating with said first tubular terminal and a plurality of second rod-shaped terminals respectively connected to said plurality of conductors for respective mating with said plurality of second tubular terminals, said second plug being substantially identical to said first plug.

* * * * *